US009845626B2

(12) United States Patent
Kunz

(10) Patent No.: US 9,845,626 B2
(45) Date of Patent: Dec. 19, 2017

(54) REMOVABLE WINDOW SASH SYSTEM WITH INTEGRATED SPRING BIASED RETAINER

(71) Applicant: John Evans' Sons, Inc., Lansdale, PA (US)

(72) Inventor: John R. Kunz, Douglassville, PA (US)

(73) Assignee: Jhn Evan's Sons, Inc., Lansdale, PA (US)

( * ) Notice: Subject to any disclaimer, the term of this patent is extended or adjusted under 35 U.S.C. 154(b) by 0 days.

(21) Appl. No.: 15/053,405

(22) Filed: Feb. 25, 2016

(65) Prior Publication Data

US 2016/0245007 A1 Aug. 25, 2016

Related U.S. Application Data

(60) Provisional application No. 62/120,866, filed on Feb. 25, 2015.

(51) Int. Cl.
*E05D 15/16* (2006.01)
*E06B 3/44* (2006.01)

(52) U.S. Cl.
CPC ..... *E05D 15/165* (2013.01); *E06B 3/44* (2013.01); *E05Y 2600/634* (2013.01); *E06B 2003/4484* (2013.01)

(58) Field of Classification Search
USPC ..... 49/183–186, 428, 414, 419, 421
See application file for complete search history.

(56) References Cited

U.S. PATENT DOCUMENTS 329,803 A * 11/1885 Ayers ..... E06B 3/44 49/421
470,914 A * 3/1892 Heffner ..... E06B 3/44 49/418
496,333 A * 4/1893 Woodard ..... E06B 3/44 49/421
560,356 A * 5/1896 Hull ..... E06B 3/44 292/74
619,657 A * 2/1899 Bauder ..... E06B 3/44 49/421
1,271,517 A * 7/1918 O'Donnell ..... E06B 3/44 49/421
1,326,345 A * 12/1919 Horton ..... E06B 3/44 49/421

(Continued)

*Primary Examiner* — Katherine W Mitchell
*Assistant Examiner* — Marcus Menezes
(74) *Attorney, Agent, or Firm* — LaMorte & Associates, P.C.

(57) ABSTRACT

A spacer that attaches to a window sash in order to create an improved window construction. The window construction has a window frame with side tracks. A window sash is set within the side tracks of the window frame. Gap spaces exist between the window sash and the side tracks. To prevent cocking, spacers are provided. The spacers attached to the sides of the window sash inside the tracks where the spacer is not visible. Each spacer has a base, a spring arm that extends from the base, and a contact head that is supported by the spring arm. The base is mounted to the window sash within a gap space. The spring arm extends into the gap space and biases the contact head toward the side track. The contact head also presents a physical barrier to lateral movement. This inhibits the sash from cocking within the window frame.

8 Claims, 8 Drawing Sheets

(56) References Cited

U.S. PATENT DOCUMENTS

| | | | | |
|---|---|---|---|---|
| 1,540,475 | A * | 6/1925 | Hight | E05D 13/08 49/421 |
| 1,770,249 | A * | 7/1930 | Busby | E05C 17/64 49/421 |
| 1,974,946 | A * | 9/1934 | Baughman | E05C 17/64 292/60 |
| 4,400,026 | A * | 8/1983 | Brown, Jr. | E05C 1/10 292/152 |
| 8,424,245 | B1 | 4/2013 | Kunz et al. | |
| 2005/0144845 | A1 | 7/2005 | Heck et al. | |

* cited by examiner

REMOVABLE WINDOW SASH SYSTEM WITH INTEGRATED SPRING BIASED RETAINER

RELATED APPLICATIONS

This application claims the benefit of provisional patent application No. 62/120,866 filed Feb. 25, 2015.

BACKGROUND OF THE INVENTION

1. Field of the Invention

In general, the present invention relates to windows that have sashes that are designed to be easily removed from a window frame. More particularly, the present invention relates to the structure of spacers that are used to prevent a window sash from cocking within a window frame as it is opened and closed.

2. Prior Art Description

There are many types of windows used in modern construction. Some windows are designed to open, some are not. Of the windows that are designed to open, some windows have sashes that open vertically and others have sashes that slide open laterally, or rotate outwardly.

Windows that have vertically opening sashes are the most common window used in residential home construction. Vertically opening windows are either single-hung, having one sash that opens, or double-hung, having two sashes that open. In both single-hung and double-hung windows, a counterbalance system is used to hold a window sash up once it is opened. If no counterbalance system is used, gravity causes the sash of the window to close as soon as it is opened and released.

Counterbalance systems for single-hung and double-hung windows typically use coil springs to counterbalance the weight of the window sashes. The presence of a counterbalance system requires that a substantial space be left between the sash of the window and the jambs of the window frame. The counterbalance system operates in this space. The counterbalance system is protected from view and from contact by using extruded window frame jambs that are generally U-shaped in cross section. The counterbalance system sits within the center of the groove defined by this track and is thus protected from sight.

When a window is manufactured, the sashes of the window are made separately from the frame of the window. The sashes are later assembled into the frame. Due to variations in manufacturing tolerances, the width of a window sash may vary by up to $1/8^{th}$ of an inch. Likewise, the distance between jambs in a window frame may also vary by up to $1/8^{th}$ of an inch. As a consequence, if an undersized sash is assembled into an oversized window frame, there may be over ¼ inch of play between the sash and the tracks of the window frame.

If a window sash has too much play in a window frame, the window sash may cock in position when moved by a person or when influenced by the counterbalance system. Additionally, if the window sash cocks in position, a gap may be created between the window and the sill, thereby greatly reducing the insulation rating for that window.

In the prior art, window sashes have been provided with spacers. However, many of the prior art spacers have drawbacks. Many spacer systems require that slots and/or grooves be milled into the structure of the window sash in order to accommodate the spacer. This adds significantly to the cost and manufacturing complexities of the window sash. Such prior art spacers are exemplified by U.S. Patent Application Publication No. 2005/0144845 to Heck et al. Other spacer systems can be retroactively added to existing window sashes, however, the spacers are visible and detract from the clean aesthetics of a flat window sash. Such prior art spacers are exemplified by U.S. Pat. No. 8,424,245 to Kunz et al.

A need therefore exists for a spacer system that can be added in a window assembly, both at its time of manufacture and retroactively, that does not require changes in the window sash and does not detract from the aesthetics of the window sash. This need is met by the present invention as described and claimed below.

SUMMARY OF THE INVENTION

The present invention is a spacer that attaches to a window sash in order to create an improved window construction. The window construction includes a window frame that has side tracks. A window sash is set within the side tracks of the window frame, wherein the window sash can move to open and close within the side tracks. In order to provide the window sash the freedom it needs to move, gap spaces exists between the window sash and the side tracks.

The presence of the gap spaces enable the sash to move laterally as it opens and closes. This can cause the window sash to cock and bind. To prevent cocking, spacers are provided. The spacers attach to the sides of the window sash inside the tracks where the spacers are not visible.

Each spacer has a base, a spring arm that extends from the base, and a contact head that is supported by the spring arm. The base is mounted to the window sash within a gap space. The spring arm extends into the gap space and biases the contact head against the side track. The contact head also overlaps a segment of the window sash, therein presenting a physical barrier that greatly reduces the degree of lateral movement achievable by the widow sash. The reduced degree of possible lateral movement inhibits the window sash from cocking within the window frame.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention system and method can be embodied in many ways, only two embodiments have been selected for the purposes of illustration and discussion. The illustrated embodiments, however, are merely exemplary and should not be considered limitations when interpreting the scope of the appended claims.

Figure 1:
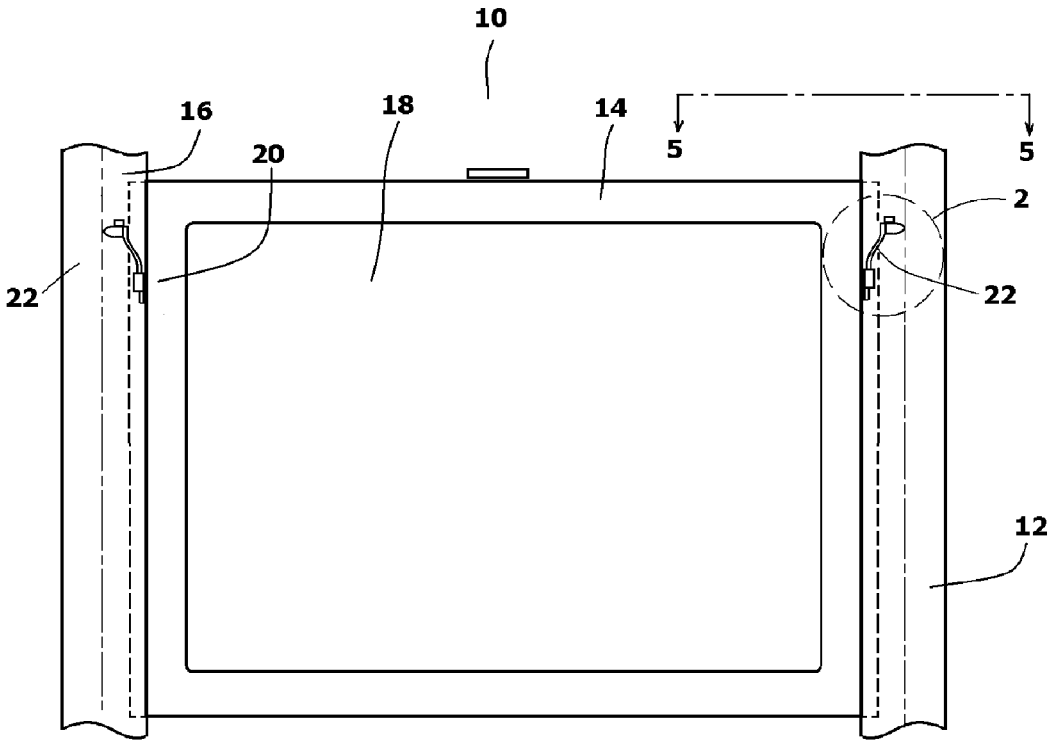
FIG. 1 shows a window sash in a window frame containing the present invention system.
Figure 2:
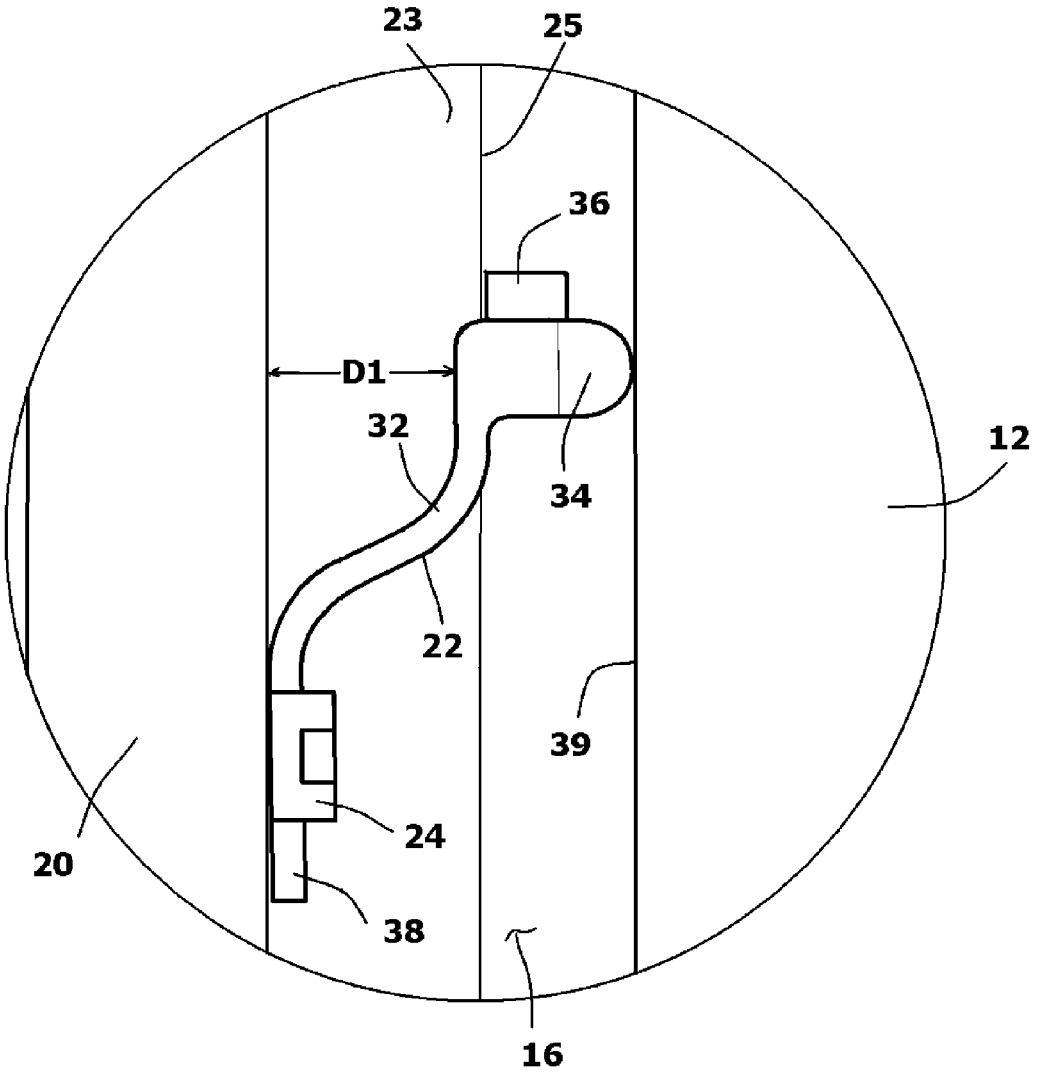
FIG. 2 shows an enlarged view of the section of FIG. 1 contained in circle 2.
Figure 3:
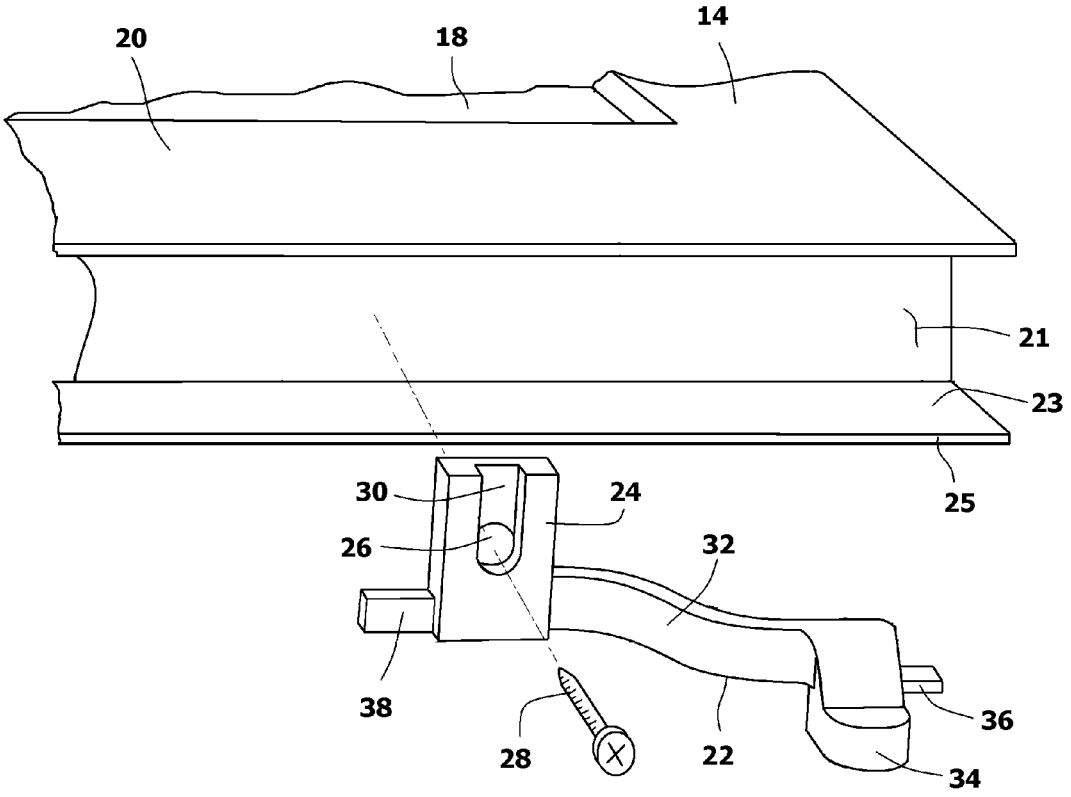
FIG. 3 shows a perspective view of the spacer and illustrates its placement on the window sash.
Figure 4:
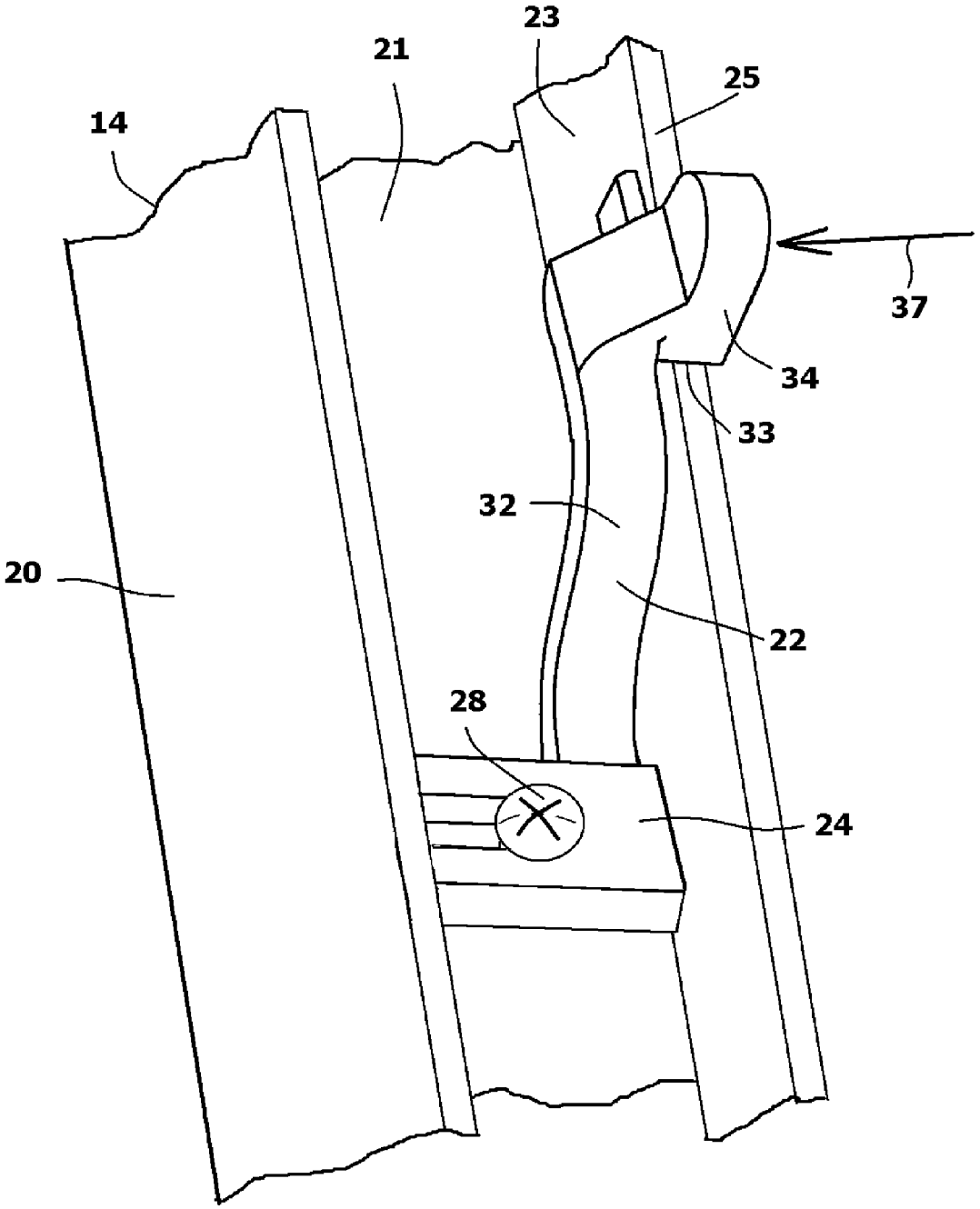
FIG. 4 shows an enlarged perspective view of the spacer and illustrates its attachment orientation in relation to the window sash.
Figure 5:
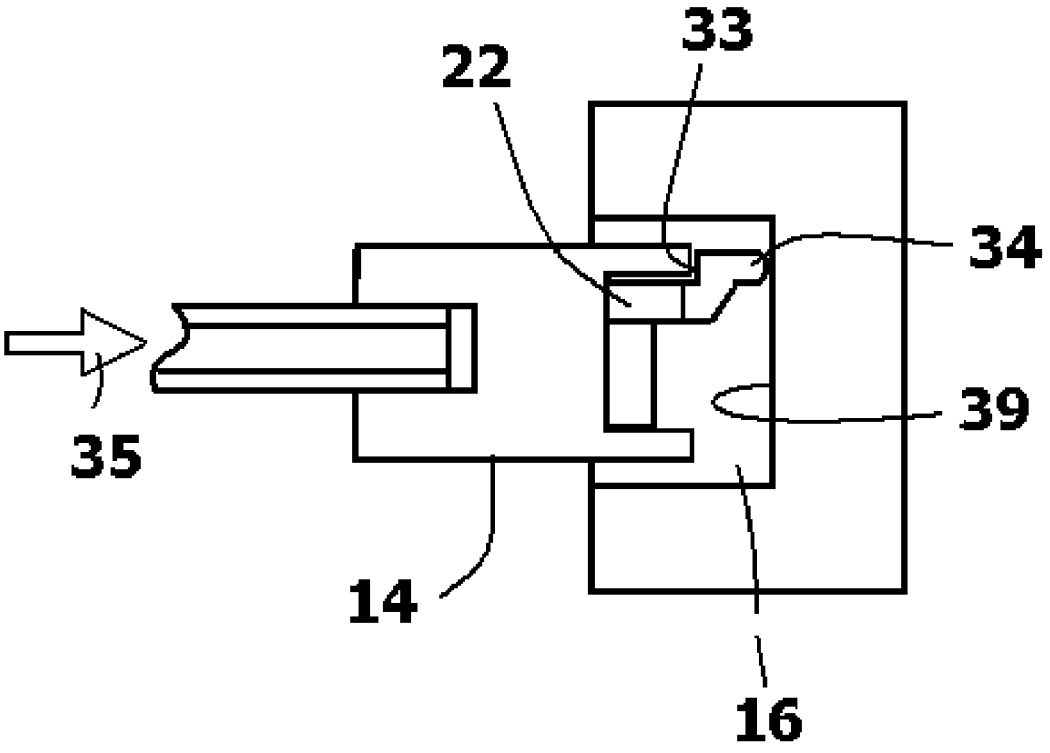
FIG. 5 shows a fragmented top view of the exemplary system of FIG. 1, viewed along section line 5-5.

Referring to FIG. 1 in conjunction with FIG. 2, FIG. 3, FIG. 4, and FIG. 5, a window assembly 10 is shown. The window assembly 10 has a window frame 12 that holds a window sash 14. The window sash 14 typically slides in tracks 16 that are formed into the sides of the window frame 12. This enables the window sash 14 to move up and down within the window frame 12.

The window sash 14 is comprised of a pane of glass 18 that is surrounded by framing elements. The framing elements include two vertical side elements 20 that are disposed on the opposite vertical sides of the pane of glass 18. The two vertical side elements 20 are parallel and extend in a vertical plane when the window sash 14 is seated vertically within the window frame 12.

A groove 21 is formed along the length of both of the vertical side elements 20. Each groove 21 is defined by two side walls 23. Each of the side walls 23 has wall edge 25 that faces the adjacent window frame 12.

Two spring biased spacers 22 are provided that attach to the vertical side elements 20 of the window sash 14 within the grooves 21. Each of the spring biased spacers 22 has a complex shape. Each spring mounted spacer 22 has a mounting base 24. A hole 26 is formed through the mounting base 24 that enables the mounting base 24 to be attached directly to the vertical side elements 20 of the window frame with a screw 28 or similar mechanical fastener.

A contoured spring arm 32 extends from the mounting base 24. The contoured spring arm 32 curves away from the vertical side element 20 of the window sash 14, as it extends away from the mounting base 24. The spring arm 32 terminates with a contact head 34. The contact head 34 is slightly offset from the spring arm 32. This creates a ledge 33 at the rear of the contact head 34. Due to the shape of the contoured spring arm 32, the contact head 34 is biased to a position where the ledge 33 behind the contact head 34 is positioned atop the wall edge 25 of the side wall 23 that faces the adjacent window frame 12. Accordingly, if a force is applied to the contact head 34 in the direction of arrow 37, the ledge 33 of the contact head 34 will press against the wall edge 25 and the contact head 34 will not move.

It will therefore be understood that the presence of the contact head 34 over the wall edge 25 of the window sash 14 has the affect of widening the window sash 14. As such, the movement of the window sash 14 in the direction of arrow 35 is reduced. As a consequence, the degree in which the window sash 14 is free to cock is significantly decreased.

The contact head 34 is spring biased into its extended position atop the wall edge 25. To remove the window sash 14 from the window frame 12, the contact head 34 must be retracted into the groove 21 on the window sash 14. The contact head 34 is supported by the contoured spring arm 32. The contoured spring arm 32 can be made of spring steel or a resilient molded plastic. As such, the contoured spring arm 32 is both flexible and resilient. Therefore, it will be understood that as the contact head 34 can be moved by deforming the contoured spring arm 32.

Since the spring biased spacer 22 is connected to the vertical side element 20 of the window sash 14, the spring biased spacer 22 moves with the window sash 14 within the window frame 12. A top stop projection 36 extends from the contact head 34 of the spring biased spacer 22. Likewise, a bottom stop projection 38 extends from the mounting base 24 of the spring biased spacer 22. The top stop projection 36 enables a person to engage and move the contact head 34 with a tool, such as a screwdriver, without damaging the contact head 34. The bottom stop projection 38 helps stabilize and align the mounting base 24 so that it does not rotate out of place.

When affected only by the bias of the contoured spring arms 32, the contact heads 34 are positioned over a wall edge 25 on the window sash 14. Furthermore, the contact heads 34 are biased against the opposing walls 39 in the tracks 16 of the window frame 12. When the window sash 14 is moving up and down in the window tracks 16, the spring bias behind the contact heads 34 remains. However, the spring biased spacers 22 do not prevent the sash 14 from moving straight up and straight down.

Figure 6:
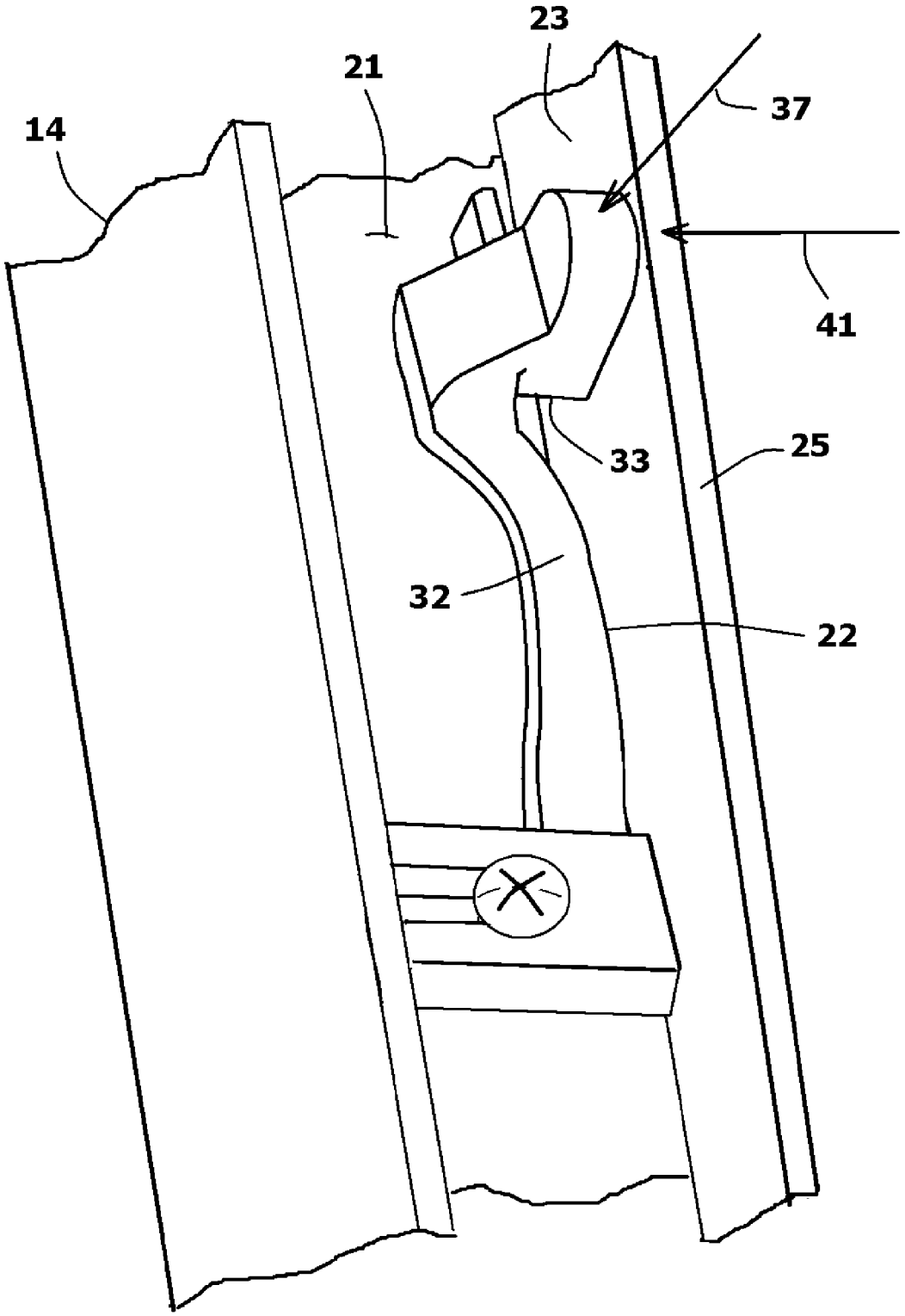
FIG. 6 shows an enlarged perspective view of the spacer and illustrates its attachment orientation in relation to the window sash as external deformation forces are applied.
Figure 7:
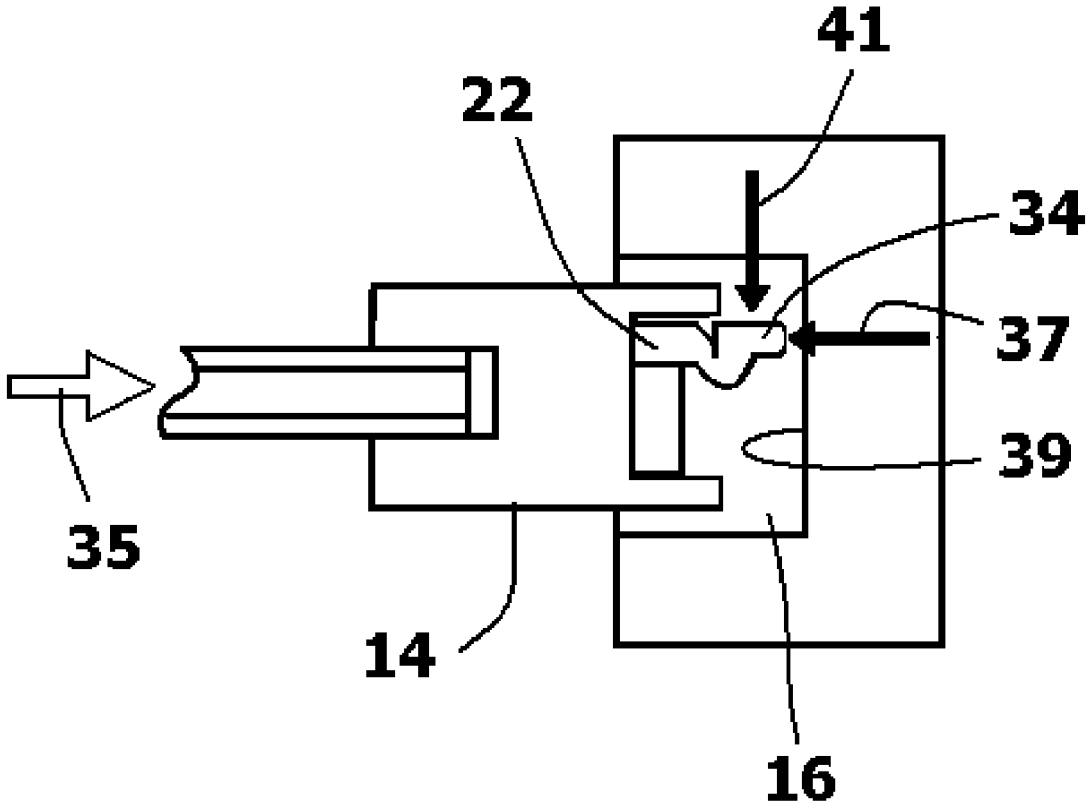
FIG. 7 is the same view perspective as FIG. 5 as external deformation forces are applied.

It will be understood that to remove a sash 14 from the window frame 12, the contact head 34 on at least one of the spring biased spacers 22 must be deformed against its spring bias back into the groove 21 of the window sash 14. Referring to both FIG. 6 and FIG. 7, it will be understood that a person can reach a finger or tool into the track 16 from atop the window sash 14 and apply forces in the direction of arrow 37 and arrow 41. The external forces are applied to the top stop projection 36 to prevent any contact damage to the contact head 34. As a force is applied in the direction of arrow 41, the contact head 34 is moved laterally out of contact with the wall edge 25. As the force is applied in the direction of arrow 37, the contoured spring arm 32 further deforms and the contact head 34 retracts into the groove 21 of the window sash 14. Once retracted, the window sash 14 can move laterally in the direction of arrow 35, while in the track 16 of the window frame 12. This lateral movement can be advanced to a point where the sash 14 disengages from the window track 16. The sash 14, once free of the track 16, can be removed from the window frame 12.

Since the spring biased spacers 22 are positioned in the guide track 16, the spring biased spacers 22 cannot be observed by a person who raises or lowers the window sash 14. Furthermore, the spring biased spacers 22 attach to the window sash 14 with a simple screw. As such, the spring biased spacers 22 can be easily added to most every window sash model and style without any alteration of the window sash.

Figure 8:
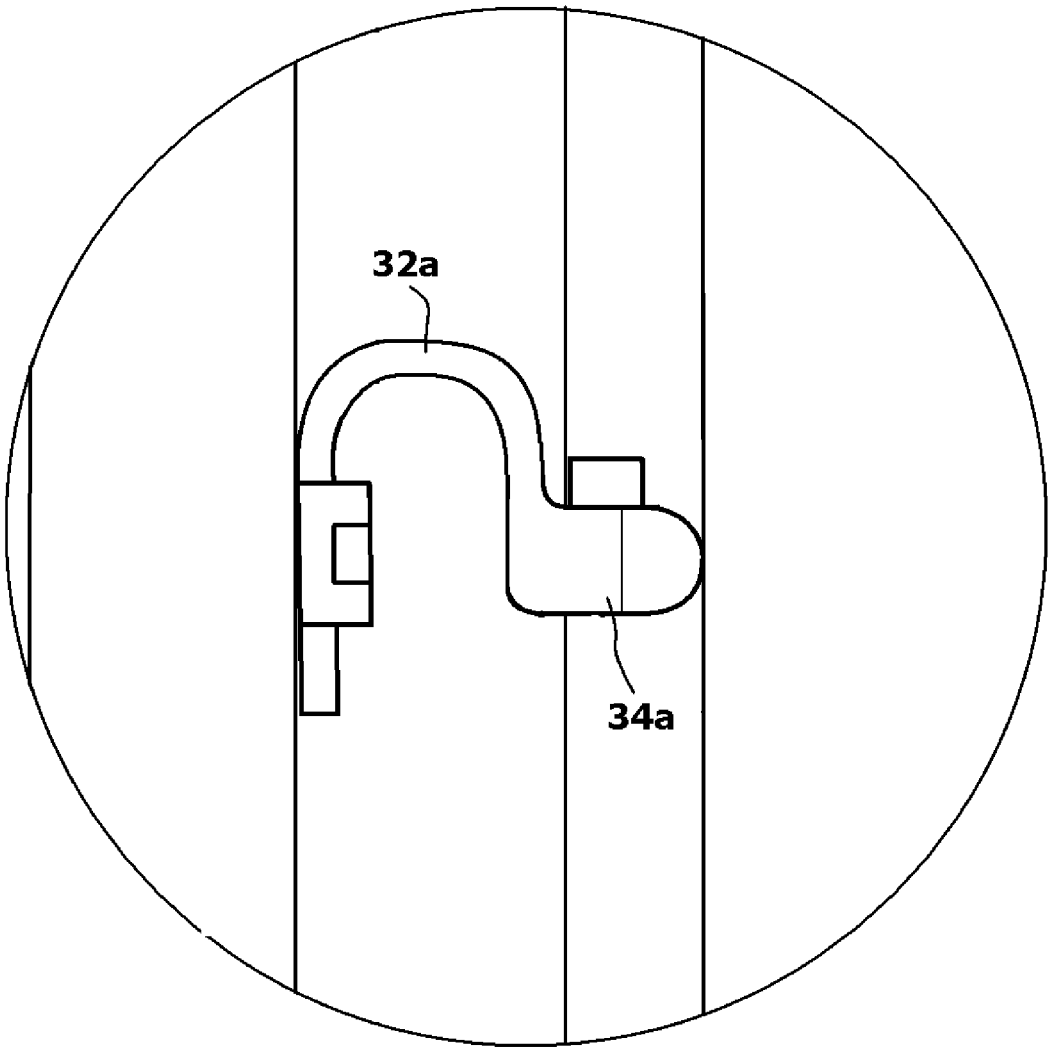
FIG. 8 shows an alternate embodiment of the spacer.

In the embodiment illustrated in FIGS. 1 through 7, the spring biased spacers 22 have a contoured spring arm 32 that is generally shaped as an inverted letter S. This shape is arbitrary. Many other shapes can be used to provide the needed spring movement to the contact head supported by the contoured spring arm. Such an alternate embodiment is shown in FIG. 8. Referring to FIG. 8, it can be seen that the contoured spring arm **32*a* can have any shape that both biases the contact head 34*a* outwardly and enables the contact head 34*a* to be deformed inwardly. In the shown alternate embodiment, the spring arm 32*a* has the shape of an inverted letter U. However, the contact head 34*a*** is still biased outwardly and performs the same functions as were previously described.

It will be understood that the embodiments of the present invention that are illustrated and described are merely exemplary and that a person skilled in the art can make many variations to those embodiments. All such embodiments are intended to be included within the scope of the present invention as defined by the appended claims.

What is claimed is:

1. A window construction, comprising:

a window frame having side tracks;

a window sash having side framing elements that are set within said side tracks of said window frame, wherein each of said side framing elements have two side walls that define a groove along each of said side framing elements, wherein each of said side walls extends along a plane and terminates along a wall edge, and wherein a gap exists between each said wall edge and said window frame;

a first spacer having a first base, a first spring arm that extends from said first base, and a first contact head supported by said first spring arm, wherein said first base is mounted to said window sash within said groove and said first spring arm biases said first contact head into a position that extends within one of said planes and that overlaps said wall edge of one of said side walls in said gap between said wall edge and said window frame, therein inhibiting said window sash from cocking within said window frame.

2. The window construction according to claim 1, wherein said first base is mounted to said window sash with a mechanical fastener that physically connects said first base to said window sash.

3. The window construction according to claim 1, further including a projection that extends outwardly from said first contact head.

4. The window construction according to claim 1, further including a second spacer having a second base, a second spring arm that extends from said second base, and a second contact head supported by said second spring arm, wherein said second base is mounted to said window sash and said second spring arm biases said second contact head into a second position that overlaps said wall edge of one of said side walls in between said wall edge and said window frame, therein inhibiting said window sash from cocking within said window frame.

5. The window construction according to claim 4, wherein said second base is mounted to said window sash with a screw that physically connects said second base to said window sash.

6. The window construction according to claim 4, further including a second projection that extends outwardly from said second contact head.

7. A window sash, comprising;

a sash framework having a first side sash element, wherein a first groove is formed between two side walls that extend along said first side sash element, wherein each of said side walls extends along a plane and terminates with a wall edge;

at least one pane of glass supported by said sash framework; and a first spacer having a first base, a first spring arm that extends from said first base, and a first contact head supported by said first spring arm, wherein said first base is mounted to said first side sash element within said first groove and said first spring arm extends away from said sash framework biasing said first contact head into a position that extends within one of said planes and that overlaps said wall edge of one of said side walls.

8. The window sash according to claim 7, further including a second spacer having a second base, a second spring arm that extends from said second base, and a second contact head supported by said second spring arm.

* * * * *